US009297384B2

(12) United States Patent
Stones et al.

(10) Patent No.: US 9,297,384 B2
(45) Date of Patent: Mar. 29, 2016

(54) SCROLL PUMP WITH OVERPRESSURE EXHAUST

(75) Inventors: Ian David Stones, Burgess Hill (GB); Miles Geoffery Hockliffe, Lewes (GB); Alan Ernest Kinnaird Holbrook, Pulborough (GB)

(73) Assignee: Edwards Limited, Crawley, West Sussex (GB)

( * ) Notice: Subject to any disclaimer, the term of this patent is extended or adjusted under 35 U.S.C. 154(b) by 95 days.

(21) Appl. No.: 14/233,026

(22) PCT Filed: Aug. 9, 2012

(86) PCT No.: PCT/GB2012/051930

§ 371 (c)(1), (2), (4) Date: Jan. 15, 2014

(87) PCT Pub. No.: WO2013/021203

PCT Pub. Date: Feb. 14, 2013

(65) Prior Publication Data

US 2014/0154123 A1 Jun. 5, 2014

(30) Foreign Application Priority Data

Aug. 11, 2011 (GB) ..... 1113843.5

(51) Int. Cl.
*F01C 1/02* (2006.01)
*F03C 2/00* (2006.01)
(Continued)

(52) U.S. Cl.
CPC ..... *F04C 28/24* (2013.01); *F01C 1/0215* (2013.01); *F04C 18/0215* (2013.01);
(Continued)

(58) Field of Classification Search
CPC ..... F04C 18/0215; F04C 18/0246; F04C 18/0253; F04C 23/008; F04C 28/24; F04C 28/26; F04C 14/24; F04C 14/262; F04C 29/126; F04C 19/08; F01C 1/0215; F01C 19/10
USPC ..... 418/6, 55.1–55.6, 57, 180, 270
See application file for complete search history.

(56) References Cited

U.S. PATENT DOCUMENTS 4,389,171 A 6/1983 Eber et al.
5,626,469 A * 5/1997 Schofield ..... 418/6
(Continued)

FOREIGN PATENT DOCUMENTS

CN 101498302 8/2009
CN 101165350 9/2012
(Continued)

OTHER PUBLICATIONS

International Search Report dated Jun. 21, 2013 for corresponding Application No. PCT/GB2012/051930, filed Aug. 9, 2012.
(Continued)

*Primary Examiner* — Theresa Trieu
(74) *Attorney, Agent, or Firm* — Westman, Champlin & Koehler, P.A.; Theodore M. Magee

(57) ABSTRACT

The present invention relates to a scroll pump with two scrolls that are co-operable for pumping fluid from an inlet to an outlet on relative orbiting motion of the scrolls. Each scroll comprises a scroll base from which a scroll wall extends generally axially towards the base of the opposing scroll. A gas conduit having an inlet at a first location of the pumping channel and an outlet at a second location of the pumping channel allows over-compression at the first location of the pumping channel to be exhausted to the second location of the pumping channel. A one-way valve located in the gas conduit allows the passage of gas through the conduit from the conduit inlet to the conduit outlet when a predetermined pressure differential between the first and second locations of the pumping channel is generated during roughing when the scroll inlet is at or close to atmosphere.

12 Claims, 7 Drawing Sheets

(51) Int. Cl.

| | |
|---|---|
| ***F03C 4/00*** | (2006.01) |
| ***F04C 2/00*** | (2006.01) |
| ***F04C 28/24*** | (2006.01) |
| ***F04C 18/02*** | (2006.01) |
| ***F04C 25/02*** | (2006.01) |
| ***F04C 28/26*** | (2006.01) |
| ***F04C 29/12*** | (2006.01) |
| *F04C 23/00* | (2006.01) |

(52) U.S. Cl.
CPC ..... *F04C 18/0246* (2013.01); *F04C 18/0253* (2013.01); *F04C 25/02* (2013.01); *F04C 28/26* (2013.01); *F04C 29/126* (2013.01); *F04C 23/008* (2013.01)

(56) References Cited

U.S. PATENT DOCUMENTS

| | | | | |
|---|---|---|---|---|
| 5,639,225 | A | 6/1997 | Matsuda et al. | |
| 5,855,475 | A | 1/1999 | Fujio et al. | |
| 6,922,999 | B2 * | 8/2005 | Kimura et al. | 418/6 |
| 2011/0058972 | A1 | 3/2011 | Patel et al. | |
| 2012/0100026 | A1 * | 4/2012 | Stones et al. | 418/55.1 |

FOREIGN PATENT DOCUMENTS

| | | | |
|---|---|---|---|
| GB | 2472635 | A | 2/2011 |
| JP | 2006177372 | A | 7/2006 |
| WO | 2011018598 | A3 | 9/2011 |

OTHER PUBLICATIONS

International Written Opinion dated Jun. 21, 2013 for corresponding Application No. PCT/GB2012/051930, filed Aug. 9, 2012.
UK Search Report dated Dec. 13, 2011 for corresponding Application No. GB1113843.5, filed Aug. 11, 2011.
Form Translation for First Office Action from the Chinese Patent Office dated Jun. 3, 2015 for corresponding Application No. CN201280039305.2, filed Aug. 9, 2012.
Translation of First Office Action from the Chinese Patent Office dated Jun. 3, 2015 for corresponding Application No. CN201280039305.2, filed Aug. 9, 2012.

* cited by examiner

SCROLL PUMP WITH OVERPRESSURE EXHAUST

CROSS-REFERENCE TO RELATED APPLICATION

This Application is a Section 371 National Stage Application of International Application No. PCT/GB2012/051930, filed Aug. 9, 2012, which is incorporated by reference in its entirety and published as WO 2013/021203 A2 on Feb. 14, 2013 and which claims priority of British Application No. 1113843.5, filed Aug. 11, 2011.

BACKGROUND

The present invention relates to a scroll pump, which is often referred to as a scroll compressor.

A prior art scroll compressor, or pump, 100 is shown in FIG. 7. The pump 100 comprises a pump housing 102 and a drive shaft 104 having an eccentric shaft portion 106. The shaft 104 is driven by a motor 108 and the eccentric shaft portion is connected to an orbiting scroll 110 so that during use rotation of the shaft imparts an orbiting motion to the orbiting scroll relative to a fixed scroll 112 for pumping fluid along a fluid flow path between a pump inlet 114 and pump outlet 116 of the compressor.

The fixed scroll 112 comprises a scroll wall 118 which extends perpendicularly to a generally circular base plate 120. The orbiting scroll 110 comprises a scroll wall 124 which extends perpendicularly to a generally circular base plate 126. The orbiting scroll wall 124 co-operates, or meshes, with the fixed scroll wall 118 during orbiting movement of the orbiting scroll. Relative orbital movement of the scrolls causes a volume of gas to be trapped between the scrolls and pumped from the inlet to the outlet.

A scroll may be used as a vacuum pump for example for evacuating a process chamber in which semiconductor products are processed. The scroll may be arranged in series with a high vacuum pump such as a turbo molecular pump or may be connected directly to a process chamber. When initial evacuation is commenced the inlet and the exhaust of the scroll pump are at atmosphere. This initial phase is often referred to as roughing and a scroll pump used in this way is referred to as a roughing pump. During roughing, gas is compressed by the scroll pump, but since the inlet is initially at atmosphere, the pump may generate over-compression in the pump. Over-compression in this context means that a pressure is generated in the pump which is above atmosphere. Over-compression is undesirable because it increases the load on the pump and therefore increases the power requirement of the pump motor.

The discussion above is merely provided for general background information and is not intended to be used as an aid in determining the scope of the claimed subject matter. The claimed subject matter is not limited to implementations that solve any or all disadvantages noted in the background.

SUMMARY

The present invention provides a vacuum pump comprising a scroll pumping mechanism which comprises:

two scrolls which are co-operable for pumping gas along a pumping channel from an scroll inlet to a scroll outlet of the mechanism on relative orbiting motion of the scrolls, a gas conduit having an inlet at a first location of the pumping channel and an outlet at a second location of the pumping channel for allowing over-compression of gas above atmosphere at the first location of the pumping channel to be exhausted to the second location of the pumping channel, and a one-way valve arrangement located in the gas conduit for allowing the passage of gas through the conduit from the conduit inlet to the conduit outlet only when a predetermined pressure differential between the first and second locations of the pumping channel is generated during roughing when the scroll inlet is at or close to atmosphere.

Other preferred and/or optional aspects of the invention are defined in the accompanying claims.

The Summary is provided to introduce a selection of concepts in a simplified form that are further described in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

In order that the present invention may be well understood, several embodiments thereof, which are given by way of example only, will now be described with reference to the accompanying drawings, in which.

DETAILED DESCRIPTION

Figure 1:
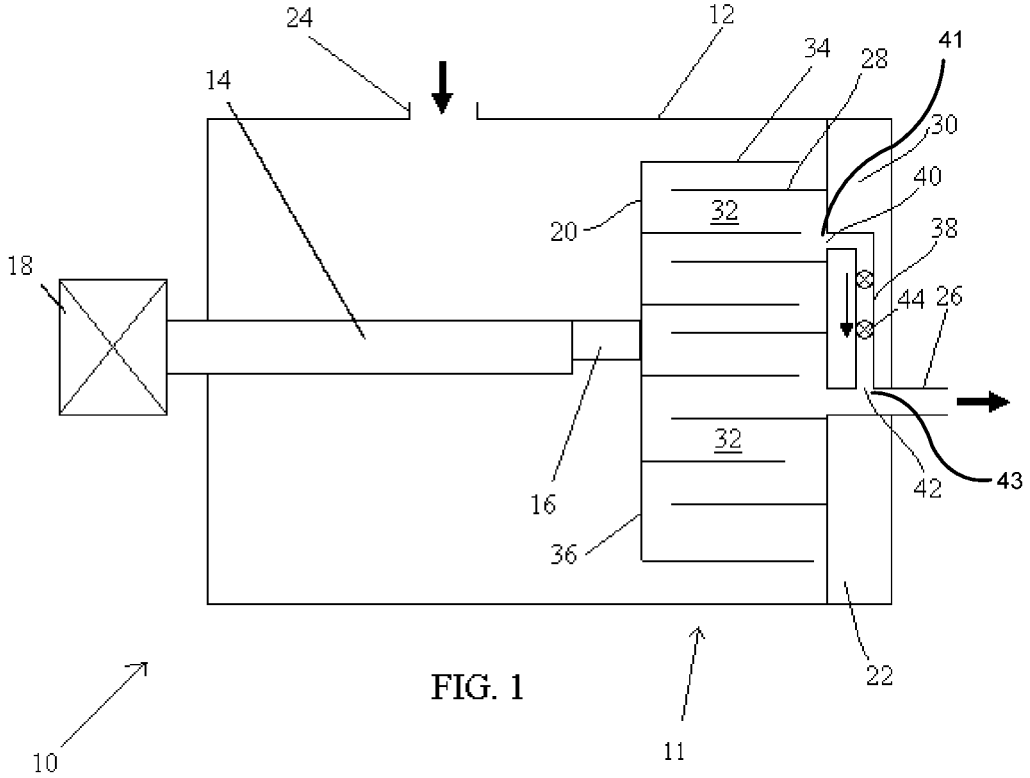
FIG. 1 shows schematically a vacuum pump comprising a scroll pumping mechanism.

A vacuum pump 10 comprising a scroll pumping mechanism 11 is shown in FIG. 1. The pump 10 comprises a pump housing 12 and a drive shaft 14 having an eccentric shaft portion 16. The shaft 14 is driven by a motor 18 and the eccentric shaft portion is connected to an orbiting scroll 20 so that during use rotation of the shaft imparts an orbiting motion to the orbiting scroll relative to a fixed scroll 22 for pumping fluid along a fluid flow path between a pump inlet 24 and pump outlet 26 of the compressor.

The fixed scroll 22 comprises a scroll wall 28 which extends perpendicularly to a generally circular base plate 30. The orbiting scroll 20 comprises a scroll wall 34 which extends perpendicularly to a generally circular base plate 36. The two scrolls 20, 22 are co-operable for pumping gas along a pumping channel 32 from a radially outer scroll inlet 25 to a radially inner scroll outlet 27 of the mechanism on relative orbiting motion of the scrolls.

A gas conduit 38 has an inlet 40 at a first location 41 of the pumping channel 32 and an outlet 42 at a second location 43 of the pumping channel for allowing over-compression at the first location 41 of the pumping channel to be exhausted to the second location 43 of the pumping channel. The first location 41 of the pumping channel is between the scroll inlet and the scroll outlet and the second location 43 of the pumping channel is at the scroll outlet 26.

Those skilled in the art of scroll pumping arrangements will be aware that fluid is pumped along two pumping channels. The pumping channels are generally parallel and are located on either side of one of the scrolls, usually the orbiting scroll. The above described gas conduit may be arranged to relieve over-compression in both of the pumping channels, or the conduit may comprise two separate elements for relieving over-compression in respective pumping channels.

Two one-way valves 44 are located in the gas conduit 38 for allowing the passage of gas through the conduit from the conduit inlet to the conduit outlet only in the direction shown by the arrow in FIG. 1. Although two one-way valves are shown a single one way valve may be used instead, although the provision of two one-way valves provides a back-up valve in the event of failure of one of the valves and ensures that gas does not leak upstream towards the scroll inlet resulting in possible contamination of the vacuum processing equipment which is evacuated by the scroll pump. In this regard, a scroll pump is capable of achieving high pressure differentials between the scroll inlet and the scroll outlet. For example, the scroll inlet can be evacuated to pressures of preferably less than 10 mbar, more preferably less than 1 mbar and still more preferably less than $10^{-1}$ mbar whilst the scroll outlet is maintained at atmosphere, or 1 bar. In these cases, the pressure differential between the scroll outlet and the scroll inlet has a ratio of greater than 100:1, 1000:1 or 10,000:1. That is, the scroll outlet has a pressure of two, three or four orders of magnitude greater than the scroll inlet. By way of comparison, positive pressure scroll pumps can achieve a pressure of about 10 to 20 bar at the scroll outlet and a pressure of 1 bar at the scroll inlet producing a pressure differential of between about 10:1 to 20:1. Accordingly, the valve arrangement is required to resist considerable pressure differentials in order to prevent gas flow upstream towards the scroll inlet. The location of two one-way valves in the conduit is able to prevent gas flow upstream and yet provides a more economic solution than a single high integrity valve.

The one-way valve arrangement has an internal resistance which must be overcome by pressure differential across the arrangement before gas will be allowed to pass along the conduit. For example, a pressure differential of 0.5 bar may be required in order to switch the arrangement from an open condition to a closed condition, although other pressure differentials may be selected depending on requirements. The valves may take any suitable form, but typical have a moveable valve plate which is biased against a valve seat by a spring. The internal resistance of the spring must be overcome in order to move the valve plate away from the seat to provide a gas passage through the valve. The internal resistance should be selected such that the valve does not open during typically encountered normal working conditions and only opens when a predetermined pressure differential between the first and second locations of the pumping channel is generated during roughing when the scroll inlet is at or close to atmosphere. That is, when the pump is initially operated, the scroll inlet is at atmosphere and the scroll outlet is at atmosphere. The scroll mechanism 11 achieves compression such that the first location 41 of the pumping channel is at a pressure higher than atmosphere so that over-compression is generated. In order to blow-off or release this pressure when the over-compression reaches a predetermined pressure of for example 1.5 bar, the pressure differential between the conduit inlet 40 and the conduit outlet 42 (which is at approximately 1 bar) is sufficient to overcome the internal resistance of the valve arrangement allowing release of over-compression to the scroll exhaust 26. Over-compression at the first location may continue while the pressure at the scroll inlet is reduced although depending on where the first location is in the pumping channel and other characteristics of the pump over-compression is not generated when the scroll inlet pressure is below 100 mbar. Therefore, over-compression may be generated when the scroll inlet is at a pressure of between 100 mbar and 1 bar.

If two one-way valves 44 are included in the valve arrangement, and each valve has an internal resistance, then the differential pressure between the first location 41 and the second location 43 must be sufficient to overcome the internal resistances of both valves.

The conductance of the gas conduit and the valves when open should be sufficient to allow relatively rapid release of over-compression in the pump without increasing the load on the pump for a substantial time. Preferably, pressure should be released in less than about 5 seconds.

The location of the gas conduit inlet 40 depends upon the pumping characteristics of the scroll pumping mechanism 11. The inlet should be at least one wrap (or) 360° from the scroll inlet i.e. where over-compression may commence and at least one wrap away from the scroll outlet. For example, it may be desired to locate inlet 40 at the second wrap where an over-compression of 0.5 bar is to be relieved (i.e. a pressure of 1.5 bar being atmospheric pressure plus 0.5 bar). In this case, the spring pressure of the valve or valves is selected to be 0.5 bar such that when the pressure at the inlet reaches 1.5 bar, gas flows through the conduit to atmosphere. It will be apparent that the location of the inlet 40 and the spring pressure of the valves can be changed to meet various different pumping and power consumption requirements.

In use, during roughing when the pump inlet 24 and scroll inlet 25 are at or close to atmosphere, co-operation of the two scrolls 20, 22 compresses gas along the pumping channel 32. Over-compression is generated at the first location 41 of the pumping channel and when the over-compression reaches a predetermined level above the inlet pressure, valves 44 are opened allowing gas to be released to the pump exhaust 26 which is at atmosphere thereby decreasing load on the pump and reducing the power consumption of the motor 18. During this initial stage, the co-operating wraps of the two scrolls 20, 22 between the first location 41 and the exhaust 26 are not used to compress gas. Over continued use of the pump, the pressure at the inlet 24 is reduced which in turn reduces pressure at the first location 41 of the pumping channel 32. When the over-compression drops below the predetermined level the valves 44 close and gas is conveyed along the remainder of the pumping channel 32 at the exhaust 26 rather than being released to atmosphere through the valves 44.

In a first condition of the pump during roughing when the scroll inlet is at or close to atmosphere the valve arrangement is closed. In a second condition when a predetermined pressure differential is generated between the first and second locations of the pumping channel during roughing and the first location is above atmosphere the valve arrangement is open. In a third condition when pressure at the scroll inlet is reduced below atmosphere (typically less than 0.5 bar) and the pressure differential between the first and second locations of the pumping channel is less than the predetermined pressure the valve arrangement is closed. In the third condition of the pump, the scroll inlet is reduced to vacuum pressures between about 10-1 mbar and 10 mbar and therefore the pressure differential across the valve arrangement is reversed compared to the pressure differential in the second condition.

Figure 2:
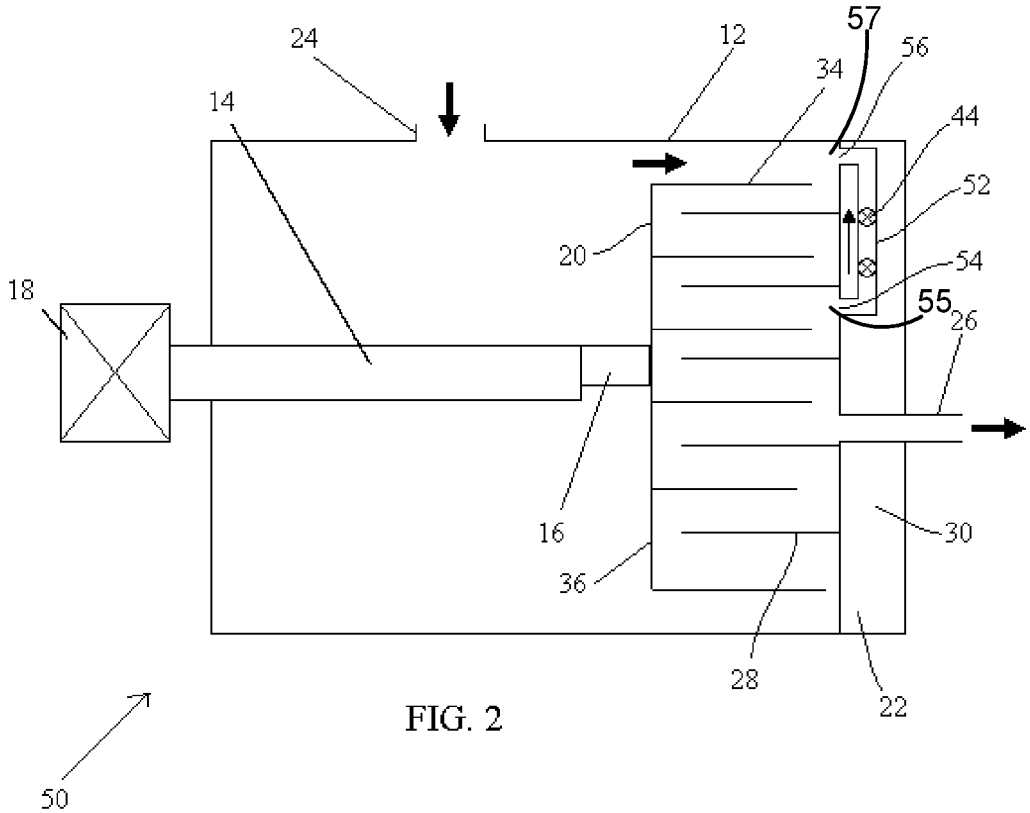
FIG. 2 shows schematically another vacuum pump comprising a scroll pumping mechanism.

In the alternative vacuum pump 50 shown in FIG. 2, the same reference numerals have been used to indicate like integers as shown in FIG. 1 and discussed above. The FIG. 2 arrangement differs from the FIG. 1 arrangement in that the gas conduit 52 extends from a first location 55 of the pumping channel 32 between the scroll inlet and the scroll outlet and a second location 57 of the pumping channel at the scroll inlet 24.

During roughing when the scroll inlet 25 is at or close to atmosphere, and over-compression is generated at the first location 55, gas is released through the gas conduit 52 when the pressure differential between the conduit inlet 54 and the conduit outlet 56 is above a predetermined level thereby decreasing load on the pump and reducing power requirements. This arrangement is effective during the initial stages of roughing. Although the pressure at the scroll inlet does not decrease significantly during the initial stage of pump down, gas continues to be pumped from the processing chamber connected to the scroll inlet. In this way, the gas conduit 52 and valve arrangement reduces the power requirement during roughing.

Figure 3:
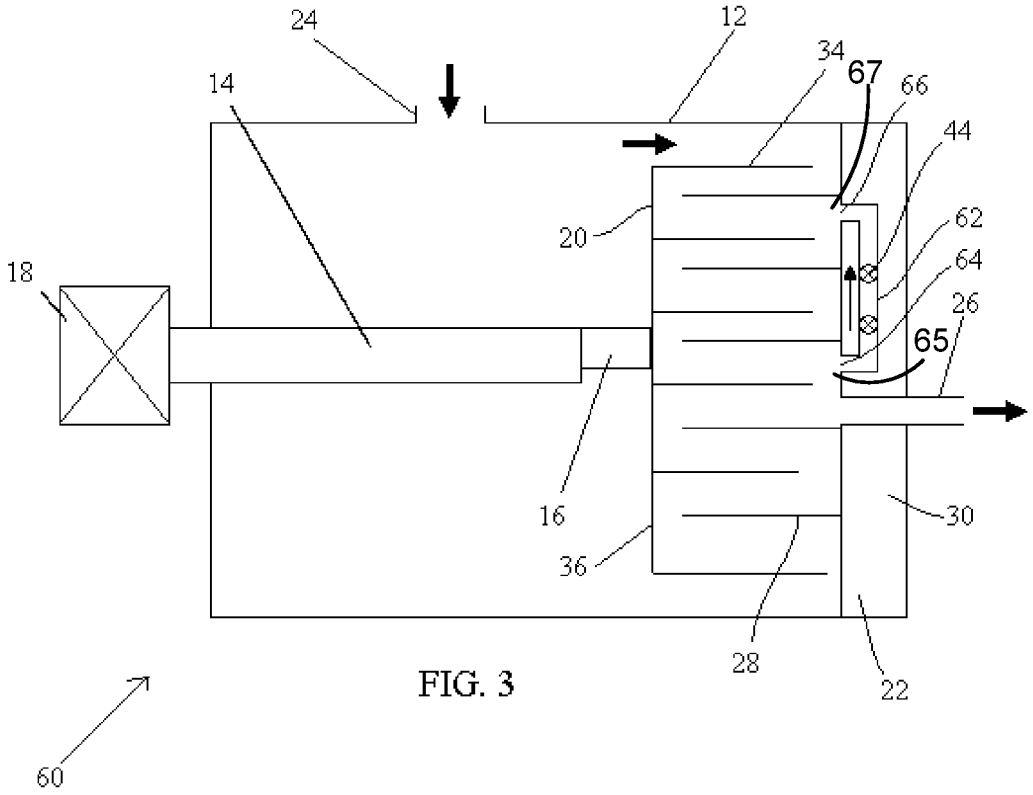
FIG. 3 shows schematically a further vacuum pump comprising a scroll pumping mechanism.

In a further vacuum pump 60 shown in FIG. 3, the same reference numerals have been used to indicate like integers as shown in FIG. 1 and discussed above. The FIG. 3 arrangement differs from the FIG. 1 arrangement in that the gas conduit 62 extends from a first location 65 of the pumping channel 32 between the scroll inlet and the scroll outlet and a second location 67 of the pumping channel which is also between the scroll inlet and the scroll outlet.

During roughing when over-compression is generated at the first location 65, gas is released through the gas conduit 62 when the pressure differential between the conduit inlet 64 and the conduit outlet 66 is above a predetermined level thereby decreasing load on the pump and reducing power requirements. The first location 65 is typically at a lower pressure than the upstream second location 67.

Figure 4:
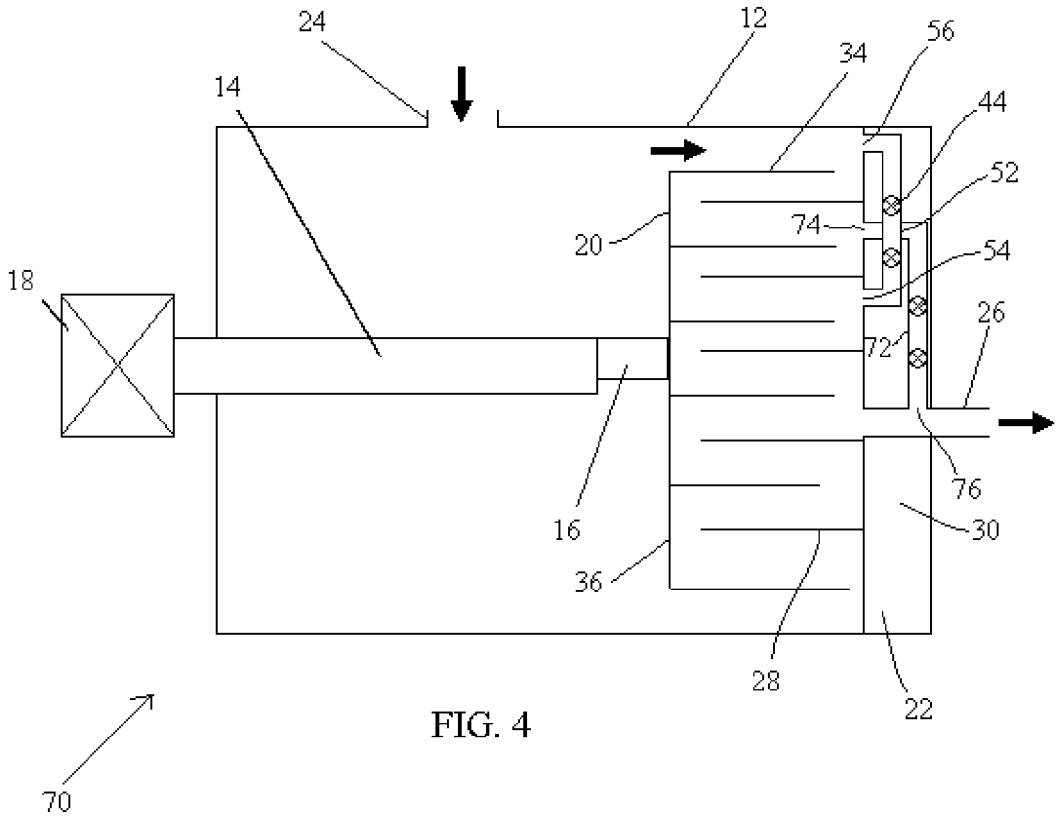
FIG. 4 shows schematically a still further vacuum pump comprising a scroll pumping mechanism.

In a further arrangement, vacuum pump 70 as shown in FIG. 4 comprises a plurality of gas conduits 52, 72 connecting respective first conduit inlets 54, 74 with respective second conduit outlets 56, 76. This arrangement may be considered a amalgamation of the FIG. 1 and FIG. 2 arrangements in which pressure can be released from a plurality of different locations of the pumping channel. Although two gas conduits are shown in FIG. 4 more than two conduits could be adopted. For example, a plurality of conduits may extend from respective first locations of the pumping channel 32 which are progressively closer to the scroll outlet 26. In this way, when over compression is generated close to the scroll inlet that pressure is released. Subsequently, when over compression is closer to the scroll outlet, that pressure is released and so on.

As shown in FIGS. 1 to 4, the or each gas conduit is formed in the scroll plate of the fixed scroll. However, the gas conduit(s) may be located elsewhere provided it has inlet and outlet in communication with the pumping channel. For example, the gas conduit(s) may be located in the orbiting scroll or may be formed by a chamber within the housing on the fixed scroll side such that inlet and outlet ports in the pumping channel allow gas to be conveyed through the chamber from one location along the pumping channel to another location along the pumping channel.

Figure 5:
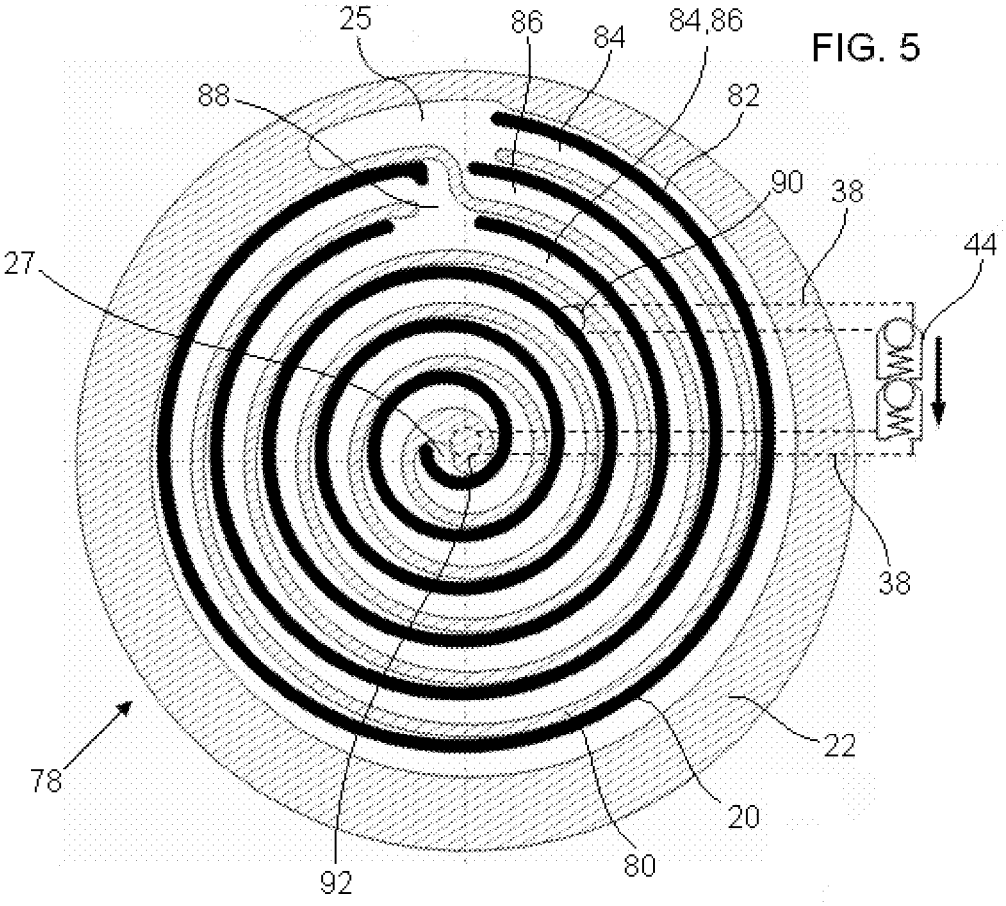
FIG. 5 shows a scroll pumping mechanism of a modified vacuum pump.
Figure 6:
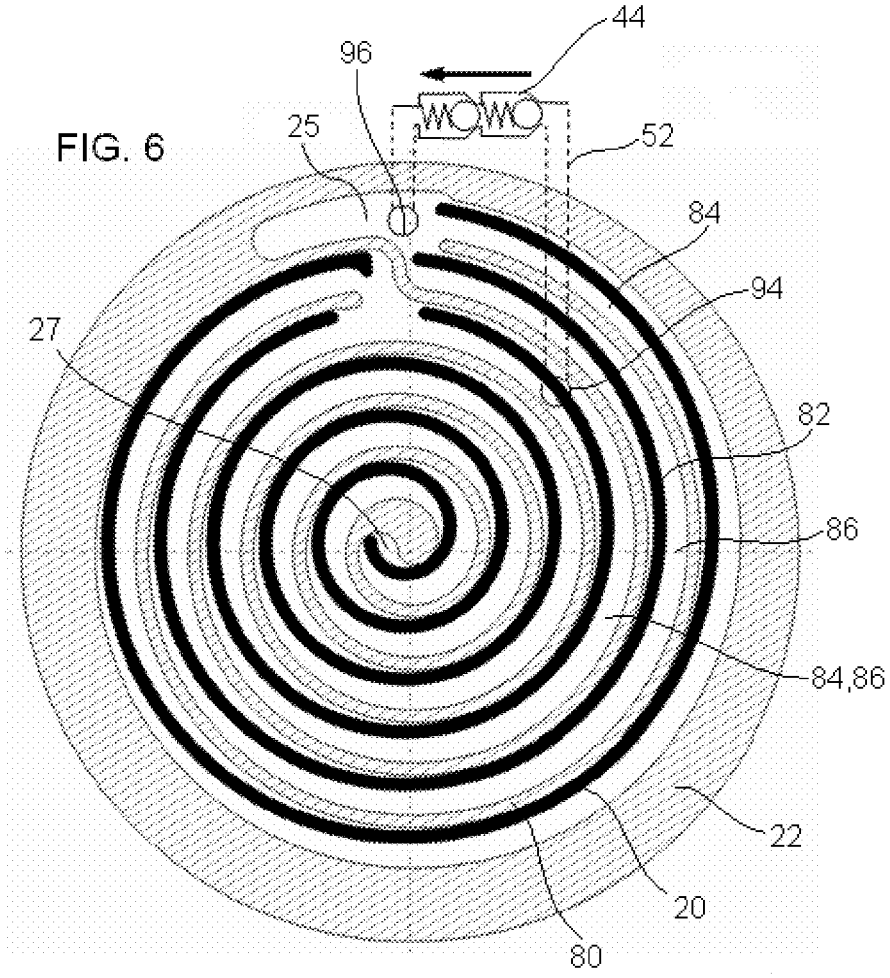
FIG. 6 shows a scroll pumping mechanism of another vacuum pump.
Figure 7:
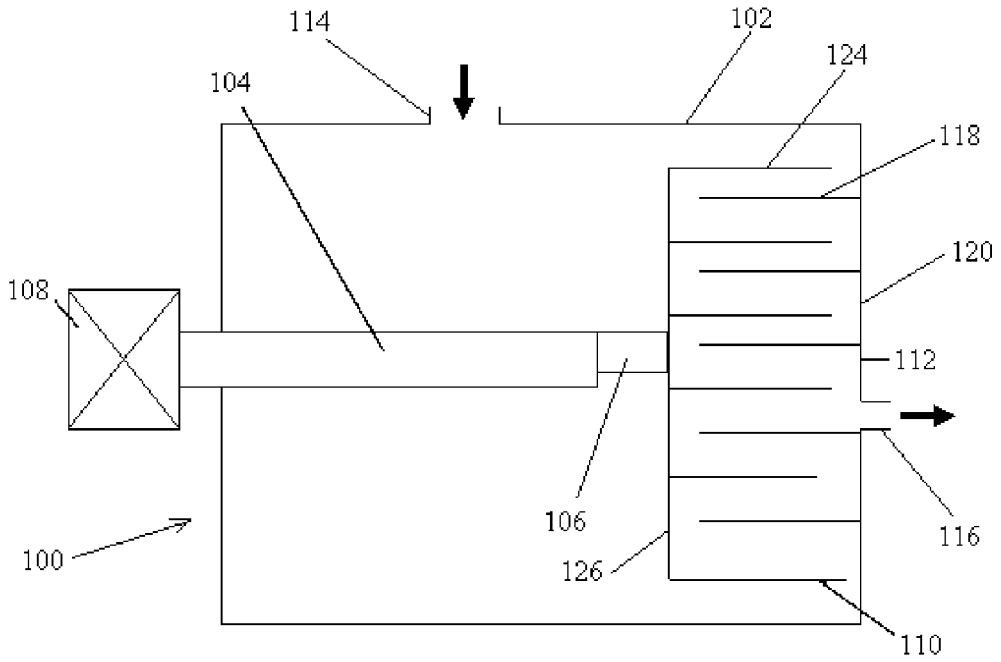
FIG. 7 (PRIOR ART)
FIG. 7 shows schematically a prior art scroll pump.

A modified scroll pumping mechanism 78 is shown in FIGS. 5 and 6 for replacing the scroll pumping mechanism 11 in FIGS. 1 to 5. The fixed scroll 22 comprises a scroll wall 80 (shown in hatching) which extends perpendicularly to the generally circular base plate 30. The orbiting scroll 20 comprises a scroll wall 82 (shown in bold) which extends perpendicularly to the generally circular base plate 36. The two scrolls 20, 22 are co-operable for pumping gas along pumping channels 84, 86 from a radially outer scroll inlet 25 to a radially inner scroll outlet 27 of the mechanism on relative orbiting motion of the scrolls.

The scroll pumping mechanism 78 comprises a first section adjacent the scroll inlet 25 and a second section adjacent the scroll outlet 27 and the pumping capacity of the first section is larger than the pumping capacity of the second section, and wherein the first location of the pumping channel is downstream of a transition between the first section and the second section. In FIGS. 5 and 6, the first section comprises a plurality of pumping channels 84, 86 extending in parallel from the scroll inlet 25. The pumping channels converge at the transition 88 between the first and second sections to form a single pumping channel 84, 86 extending from the transition to the scroll outlet. This multi-start arrangement produces a higher capacity because two channels are pumping gas through the scroll inlet rather than only one channel in the FIGS. 1 to 4 single start arrangement. However, a multi-start arrangement has a greater propensity to generate over-compression particularly at the transition between the first and second sections as the two channels converge. A bypass conduit 38 extends between first and second locations of the pumping channel 84, 86 in a similar way that shown in FIG. 1, namely between a first location 90 between the scroll inlet and the scroll outlet and a second location 92 at the scroll outlet. A one-way valve arrangement 44 as described above is positioned in the conduit. The first location 90 of the bypass arrangement is downstream of the convergence and enables the over-compression caused particularly at the convergence of the pumping channels to be relieved and therefore for power consumption as a result of the increased pressure to be reduced. The closer the first location is to the convergence point the lower the increase in power caused by pressure increase at the convergence.

In the scroll pumping mechanism of FIG. 6, the first location 94 of the bypass arrangement is located close to the convergence 88 between pumping channels so that it can be most effective in relieving a pressure increase at the convergence. The second location 96 is upstream of the first location and is similar to the arrangement shown in FIG. 2. The first location 94 is within one scroll wrap of the convergence and as shown is about 45 degrees downstream of the convergence. The provision of two-valves provides an effective seal to resist the passage of gas from the second location to the first location.

In FIGS. 5 and 6, the first section of the scroll pumping mechanism is a higher capacity than the second pumping capacity. This increased capacity at the scroll inlet 25 is provided by the parallel pumping channels 84 and 86. In an alternative arrangement, the first section of the scroll mechanism comprises a single pumping channel adjacent the scroll inlet but the pumping channel of the first section is deeper than the pumping channel of the second section. A deeper, axially more extensive, channel has a greater pumping capacity than a shallower channel. The transition between the first and second sections causes an increase in pressure in the same way as described above and the provision of a bypass arrangement relieves the pressure. In a further alternative, the first section of the scroll pump may comprise a multi-start arrangement together with deeper channels in a combination of the two types of scroll mechanisms.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

The invention claimed is:

1. A vacuum pump comprising a scroll pumping mechanism which comprises:

two scrolls which are co-operable for pumping gas along a pumping channel from a scroll inlet to a scroll outlet of the mechanism on relative orbiting motion of the scrolls, a gas conduit having an inlet at a first location of the pumping channel and an outlet at a second location of the pumping channel for allowing over-compression of gas above atmosphere at the first location of the pumping channel to be exhausted to the second location of the pumping channel, and a one-way valve arrangement located in the gas conduit for allowing the passage of gas through the conduit from the conduit inlet to the conduit outlet only when a predetermined pressure differential between the first and second locations of the pumping channel is generated during roughing when the scroll inlet is at or close to atmosphere;

wherein the scroll pumping mechanism further comprises a first section adjacent the scroll inlet and a second section adjacent the scroll outlet and the pumping capacity of the first section is larger than the pumping capacity of the second section and the first section has a deeper pumping channel than the second section, and wherein the inlet of the gas conduit is downstream of a transition between the first section and the second section.

2. The vacuum pump as claimed in claim 1, wherein in a first condition of the pump during roughing when the scroll inlet is at or close to atmosphere the valve arrangement is closed, in a second condition when a predetermined pressure differential between the first and second locations of the pumping channel is generated during roughing the valve arrangement is open, and in a third condition when pressure at the scroll inlet is reduced below atmosphere and the pressure differential between the first and second locations of the pumping channel is less than the predetermined pressure the valve arrangement is closed.

3. The vacuum pump as claimed in claim 1, wherein the one-way valve arrangement comprises two one-way valves located in the gas conduit for resisting the passage of gas through the conduit from the conduit inlet to the conduit outlet when closed and allowing the passage of gas through the conduit when open.

4. The vacuum pump as claimed in claim 3, wherein the the one-way valve arrangement is arranged to prevent the passage of gas from the conduit outlet to the conduit inlet when the pressure at the conduit outlet is at least two orders of magnitude greater than the pressure at the conduit inlet.

5. The vacuum pump as claimed in claim 1, wherein the inlet of the gas conduit is located less than one wrap of the pumping mechanism downstream of the transition.

6. The vacuum pump as claimed in claim 1, wherein the first location of the pumping channel is between the scroll inlet and the scroll outlet and the second location of the pumping channel is at the scroll outlet.

7. The vacuum pump as claimed in claim 1, wherein the first location of the pumping channel is between the scroll inlet and the scroll outlet and the second location of the pumping channel is at the scroll inlet.

8. The vacuum pump as claimed in claim 1, wherein the first location of the pumping channel is between the scroll inlet and the scroll outlet and the second location of the pumping channel is between the scroll inlet and the scroll outlet.

9. The vacuum pump as claimed in claim 1, comprising a plurality of said gas conduits connecting respective first conduit inlets with respective second conduit outlets.

10. The vacuum pump as claimed in claim 9, wherein each of said gas conduits comprises one or more of said one-way valve arrangements.

11. The vacuum pump as claimed in claim 1, wherein the two scrolls comprise a fixed scroll and an orbiting scroll and the or each gas conduit is formed in the fixed scroll.

12. The vacuum pump as claimed in claim 1, wherein during roughing the scroll inlet is at a pressure between 100 mbar and atmosphere.

* * * * *